United States Patent [19]

Sullivan

[11] 4,324,184

[45] Apr. 13, 1982

[54] TEMPERATURE CONTROL SYSTEM AND METHOD FOR AN AUTOMATED GUIDEWAY TRANSIT SYSTEM

[75] Inventor: Donald P. Sullivan, Burnsville, Minn.

[73] Assignee: Universal Mobility, Inc., Salt Lake City, Utah

[21] Appl. No.: 149,602

[22] Filed: May 13, 1980

Related U.S. Application Data

[63] Continuation-in-part of Ser. No. 133,194, Mar. 24, 1980, abandoned.

[51] Int. Cl.[3] ..... G08B 21/00

[52] U.S. Cl. ..... 104/279; 174/211; 219/213; 237/1 R; 246/428; 340/584

[58] Field of Search ..... 104/279; 246/428; 219/213; 340/584; 237/1 R; 174/211

[56] References Cited

U.S. PATENT DOCUMENTS

| | | | |
|---|---|---|---|
| 3,585,355 | 6/1971 | Nasser | 219/213 |
| 3,806,702 | 4/1974 | Spencer | 219/213 |
| 4,051,466 | 9/1977 | Protze | 219/213 |

*Primary Examiner*—Richard A. Bertsch

*Attorney, Agent, or Firm*—H. Ross Workman; Rick D. Nydegger

[57] ABSTRACT

A temperature control system and method for controlling the bus bar temperature of an automated guideway transit system in relation to the ambient dew point temperature. A resistance temperature device detects the temperature of the bus bars, and a dew point cell detects the dew point temperature of the ambient atmosphere. A first transmitter converts the detected bus bar temperature to a first electrical signal, and then amplifies and transmits the first electrical signal. A second transmitter converts the detected dew point temperature to a second electrical signal, and then amplifies and transmits the second electrical signal. A first electronic comparator receives the transmitted signals and detects the magnitude of the difference between the two signals. When the magnitude of the difference between the two signals reaches a set level, an output signal is triggered. A second electronic comparator generates an output signal whenever the detected bus bar temperature is less than or equal to a preset value (approximately 32° F. (0° C.)). The outputs from the two comparators are used to trigger an AND gate, which in turn energizes a relay used to turn on a heating element, thus keeping the bus bar temperature within a set range of the ambient dew point temperature.

28 Claims, 3 Drawing Figures

TEMPERATURE CONTROL SYSTEM AND METHOD FOR AN AUTOMATED GUIDEWAY TRANSIT SYSTEM

BACKGROUND

1. Related Application

This application is a continuation-in-part of my copending U.S. patent application Ser. No. 133,194, filed Mar. 24, 1980, now abandoned.

2. Field of the Invention

The present invention relates to a temperature control system and method, and in particular to a system and method for preventing the formation of frost or dew on the control rails or power rails of an automated guideway transit (AGT) system by controlling the temperature of the rails in relation to the dew point temperature of the ambient atmosphere.

3. The Prior Art

There are a number of different types of situations where it is necessary to control the temperature of an object in order to prevent the formation of frost or dew on the object. Illustrative of one such situation is the problem of controlling the temperature of the power rails and control rails (hereinafter collectively referred to as bus bars) of an AGT system. Formation of dew or frost on the bus bars and on other parts of an AGT system increases the hazard to passengers and/or may reduce the AGT system's operating efficiency. In addition, wide variations in the temperature of such bus bars, which are commonly constructed from aluminum, copper, nichrome or steel, cause increased wear on these components because of the relative motion created by thermally induced expansion and contraction actions.

In the past, temperature control systems in use with AGT systems have attempted to prevent the formation of frost or dew on the bus bars of the track by monitoring the ambient temperature and turning on a bus bar heater when the ambient temperature approaches the freezing point (i.e. 32° F. or 0° C.). Another approach has been to monitor the bus bar structural temperature and to turn on a heater when the bus bar structural temperature approaches the freezing point. Although these types of systems might help in preventing the formation of frost or dew on the bus bars of an AGT system, various problems continue to hamper this type of system.

For example, during the night the bus bars and other components of an AGT system may radiate heat energy. Thus, the ambient temperature may be above the freezing point, yet at times the temperature of the bus bars may be below the freezing point, resulting at times in the formation of frost or dew thereon.

In addition, the formation of frost or dew is a function of the dew point of the ambient atmosphere, which in turn is a function of the air temperature, humidity and vapor pressure of the air. During freezing weather, when the temperature of the bus bars reaches the ambient dew point temperature frost or dew will begin to form thereon. Since the ambient dew point temperature may at times be many degrees lower than the freezing point, keeping the AGT system bus bars above the freezing point results in wasted energy.

Thus, what is needed is a temperature control system capable of sensing the bus bar structural temperature of an AGT system and that will thereafter control the bus bar temperature in relation to the ambient dew point temperature. By maintaining the bus bar temperature slightly above the ambient dew point temperature, less energy is required to heat the bus bars and the formation of frost or dew thereon is more efficiently controlled. An additional benefit is that the temperature of the bus bars and heating system elements remains more nearly constant, thus preventing the wear due to the relative motions associated with the expansion and contraction of aluminum or other power distribution system materials when undergoing wide temperature variations.

BRIEF DESCRIPTION AND OBJECTS OF THE INVENTION

The present invention is directed to a system and method which, in one presently intended application, may be used for controlling the temperature of the bus bars of an AGT system. The bus bar temperature is monitored and is compared to the dew point temperature of the ambient atmosphere. When the bus bar temperature reaches the freezing point and the difference between the bus bar temperature and the ambient dew point temperature reaches a predetermined level, a heating element is energized so as to heat the bus bars, thus maintaining them at a temperature that is slightly above the dew point temperature of the ambient atmosphere.

It is therefore a primary object of the present invention to provide an improved system and method for controlling the temperature of an object in relation to the ambient dew point temperature.

Another object of the present invention is to provide an inexpensive and effective system and method for sensing the bus bar temperature of an AGT system and sensing the ambient dew point temperature and controlling a heating element in response to the detected bus bar structural temperature and the detected ambient dew point temperature.

Another object of the present invention is to reduce the energy necessary to control the bus bar temperature of an AGT system so as to minimize the effects of wear on the bus bars due to expansion/contraction of the system components.

Another object of the present invention is to reduce the energy costs of operating the bus bar heating system and therefore the cost of the entire AGT system operation.

These and other objects and features of the present invention will become more readily apparent from the following description and appended claims taken in conjunction with the accompanying drawings.

DETAILED DESCRIPTION OF THE PREFERRED EMBODIMENT

Figure 1:
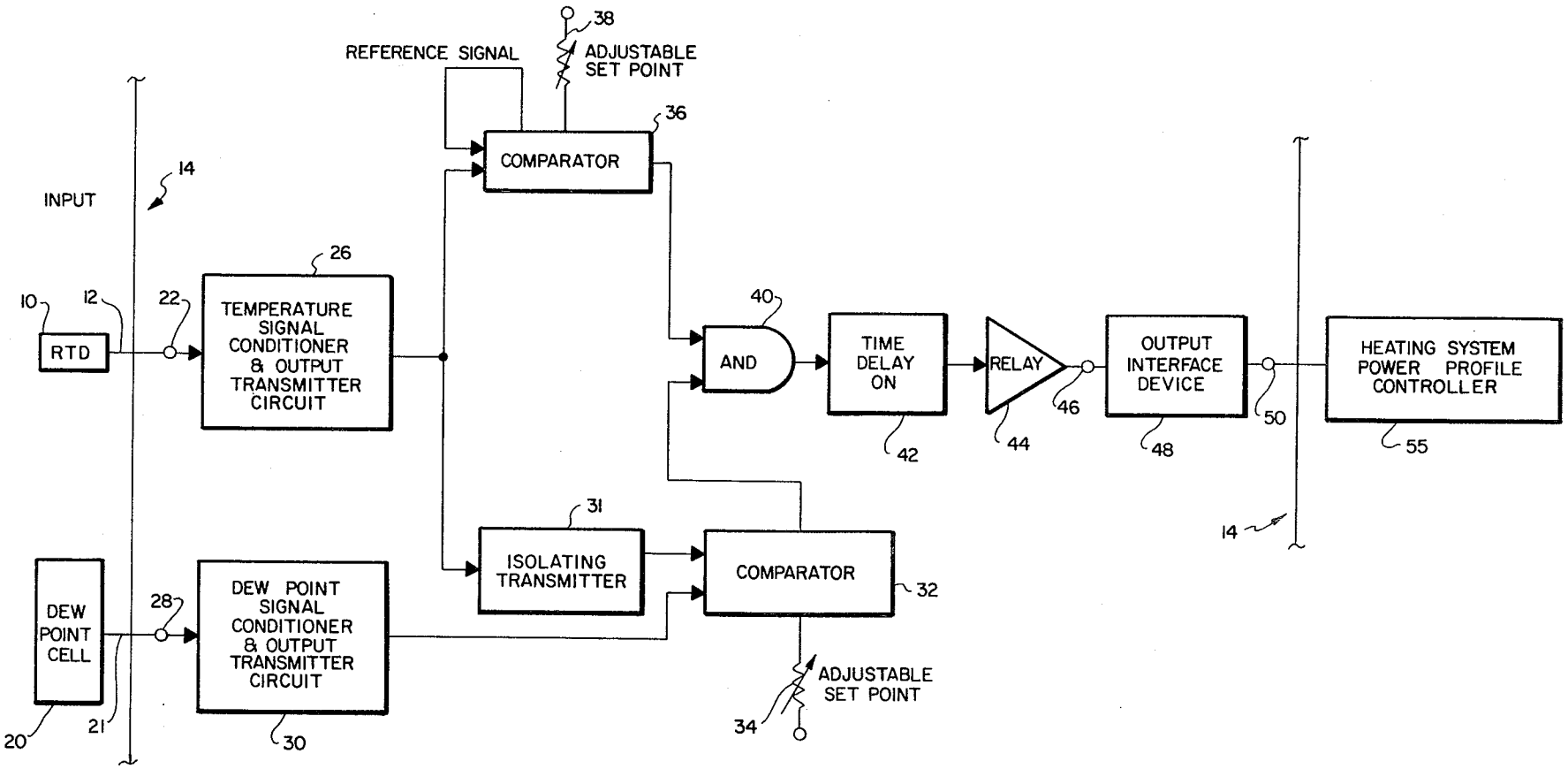
FIG. 1 is a schematic diagram of the various components of one presently preferred embodiment of the present invention.

Reference is now made to the drawing wherein like parts are designated with like numerals throughout.

The system and method of the present invention may be used in a variety of different types of applications for purposes of controlling the temperature of an object in relation to the ambient dew point temperature. One such application is the problem of controlling the bus bar temperature of an AGT system for purposes of preventing the formation of frost or dew on the bus bars during freezing temperatures.

One preferred embodiment of the present invention which may be used in this type of application is more particularly illustrated by the schematic block diagram of FIG. 1. As shown in FIG. 1, a sensor 10 is provided that consists of a resistance temperature device (RTD). As hereinafter more fully described, the RTD 10 is placed in thermal contact with one of the AGT system bus bars for purposes of detecting the bus bar temperature. Although in the illustrated embodiment only one RTD is shown, clearly it would be within the scope of the present invention to provide a plurality of switched RTD's for purposes of independently monitoring various segments of the AGT system bus bars.

The RTD 10 consists of a conventional probe (not shown) having a resistance element which may be, for example, a platinum element with a resistance that will vary in proportion to the change in temperature detected by the probe. The RTD 10 is commercially available and may be, for example, a Yellow Springs Instrument (YSI) platinum element PT-139AW or any other type of platinum RTD with comparable resistance versus temperature characteristics.

Figure 2:
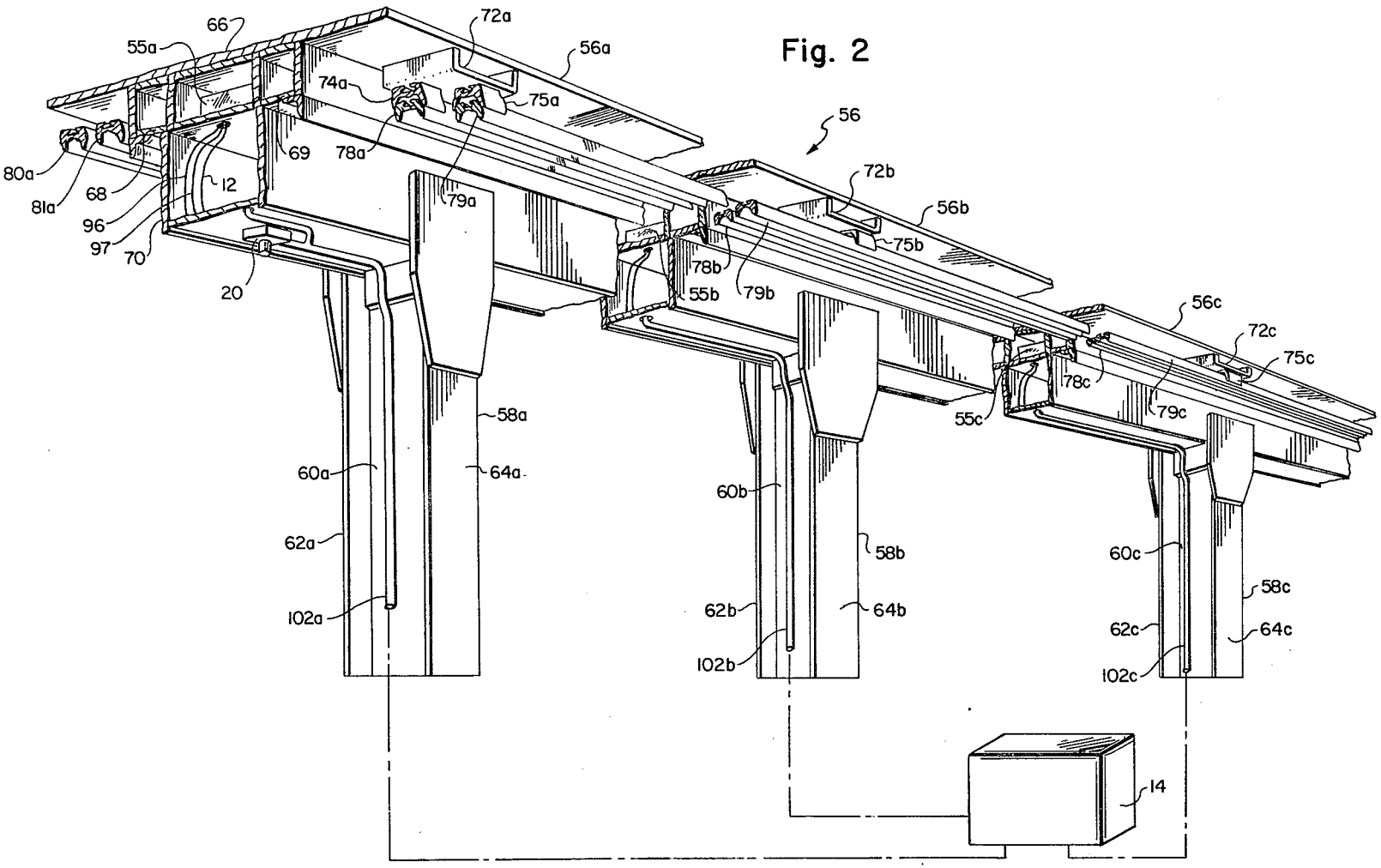
FIG. 2 is a fragmentary perspective view of one presently preferred embodiment of the temperature control system of the present invention as used to control the bus bar temperature of an AGT system guideway assembly.

RTD 10 is coupled through a cable, schematically illustrated by the line 12, to the input terminal 22 provided in a remote control panel generally designated at 14 (see also FIG. 2). Input terminal 22 couples RTD 10 to an electronic circuit 26. In the illustrated embodiment, electronic circuit 26 may be, for example, a YSI 1250 solid state circuit prepared on a printed circuit board and housed in the control panel 14. The YSI 1250 solid state circuit is commercially available and is designed to convert the temperature sensed by the RTD 10 into a proportional output voltage. The output voltage of circuit 26 may be on the order of one millivolt per degree Fahrenheit and may range from −40 to +140 millivolts. Clearly, any type of solid state or integrated circuit having performance characteristics comparable to those of the YSI 1250 solid state circuit could be used.

With further reference to FIG. 1, the dew point temperature of the ambient atmosphere may be sensed using a conventional dew point cell 20 (see also FIG. 2). As with the RTD 10, a plurality of dew point sensors could be used to independently monitor the dew point temperature for various sections of track. Dew point cell 20 may be, for example, a commercially available YSI 9400 dew point cell. The YSI 9400 dew point cell consists of bifilar heater electrodes (not shown) wound on a fiberglass wick (not shown) surrounding a precision platinum RTD. The wick is impregnated with lithium chloride, a hygroscopic salt which becomes increasingly conductive as it absorbs moisture from the surrounding air. When a voltage is applied to the heater electrodes, moisture evaporates from the wick until a heat-moisture equilibrium is reached. The temperature at this equilibrium point corresponds to the dew point temperature of the ambient atmosphere, and is sensed by the platinum RTD contained in the wick. Clearly, other commercially available types of dew point sensors could be used, as for example optical type sensors.

The ambient dew point temperature detected by the dew point cell 20 is transmitted through a cable schematically illustrated at line 21 and is input to the control panel 14 at an input terminal 28. From input terminal 28, the dew point cell 20 is connected to an electronic circuit 30. In the illustrated embodiment, circuit 30 is a commercially available YSI 1294 solid state circuit. Like the YSI 1250 solid state circuit described above, the YSI 1294 solid state circuit is designed to provide an output voltage that is proportional to the detected dew point temperature. The output voltage may vary in increments of 1 millivolt per degree Fahrenheit over a range of −40 to +140 millivolts. Thus, the dew point transmitter circuit 30 converts the detected ambient dew point temperature into an electrical signal that is proportional to the detected ambient dew point temperature and then amplifies and transmits the amplified signal at its output. In like manner, the temperature transmitter circuit 26 converts the detected bus bar temperature for each segment of the AGT system into an electrical signal that is proportional to the detected bus bar temperature and then amplifies and transmits the amplified signal at its output.

The output signal from the electronic temperature transmitter circuit 26 is input to an isolating transmitter circuit 31. The isolator circuit 31 is a commercially available AP4310 circuit manufactured by Action Instruments Co., Inc. The isolator circuit 31 provides a proportional dc output signal that is electrically isolated from the input, line power and ground so as to eliminate ground loops. From the isolating transmitter 31, the bus bar temperature signal is input to an AP3000 comparator circuit 32. The output signal from the electronic dew point transmitter circuit 30 is also input to the AP3000 comparator circuit 32. The AP3000 comparator circuit 32 detects the magnitude of the difference between the signals received from the electronic circuits 26 and 30. Since the signals output from electronic circuits 26 and 30 are proportional to the detected bus bar temperature and the ambient dew point temperature respectively, the difference between the signals is proportional to the difference between the ambient dew point temperature and the bus bar temperature. The electronic comparator circuit 32 is designed to provide an output signal when the detected difference reaches a predetermined level, as for example whenever the bus bar temperature is within 2° F. of the dew point temperature. A potentiometer 34 may be used to adjust the level at which the detected difference between the input signals will trigger the output signal from comparator 32.

The output from the electronic circuit 26 is also used as an input to a second comparator circuit 36. Electronic comparator circuit 36 may also be an AP3000 comparator circuit. Comparator 36 compares the bus bar temperature signal from transmitter circuit 26 to an internal voltage signal that is set so as to correspond to the freezing point, 32° F. (0° C.). The potentiometer 38 is adjusted so that comparator 36 will trigger an output signal whenever the difference between the bus bar temperature signal and the internally set reference signal is less than or equal to a specified value. As hereinafter more fully described, the output signal from comparator 36 may be used to disable the temperature control system in order to prevent the system from operating when the bus bar temperature of the AGT system is above the freezing point.

The output signals from comparators 36 and 32 are each gated through a conventional AND gate 40. AND gate 40 may be any type of commercially available AND gate manufactured by a number of well known companies. The AND gate 40 will trigger an output signal whenever it simultaneously receives a signal from both the comparator 36 and the comparator 32. No signal is generated by AND gate 40 if an output signal is received from only one of the comparators 36 or 32. In other words, in the illustrated embodiment the AND gate 40 serves to disable the temperature control system if the bus bar temperature of the AGT system is above the freezing point, as detected by comparator 36. Clearly, other suitable types of logical gating functions could be substituted for the AND gate 40.

The output from AND gate 40 is used to trigger a time delay circuit 42. The time delay circuit 42 is a conventional delay circuit that operates to energize the electronic relay 44 only in response to an input signal of a predetermined magnitude and duration from the AND gate 40. Thus, time delay circuit 42 prevents the relay 44 from being energized because of an erroneous signal caused by noise or other temporary interference with the control circuitry.

Relay 44 is connected through an output terminal 46 to an output interface device 48. The output interface device 48 may consist of a single contactor, a multipointed relay or a radio transmitter, any of which may be used to energize the heating elements for one or more sections of the AGT system. The interface device 48 is connected through the output terminal 50 to a heating system power profile controller 55. The power profile controller circuit 55 may be used to gradually turn on the bus bar heating element rather than simply turning the heating elements on or off. The power profile controller may be, for example, a conventional ramp circuit, a stepped ramp circuit or any suitable switching circuit that controls the energy provided to the heating elements along the various sections of the AGT system. The power profile controller circuit 55 thus insures that the heating elements will not be prematurely worn out and also insures that the energy required to heat the AGT system bus bars will be minimized, and prevents high voltage drops on the power distribution system.

Clearly it would be within the scope of the present invention to have the output interface device 48 capable of turning on a plurality of heating system power profile circuits, each of which may vary the power profile for the heating elements located along a particular section of the AGT system.

One preferred method for using the temperature control apparatus described above is schematically illustrated in FIG. 2. As shown in FIG. 2 one preferred embodiment of an AGT monorail guideway is generally designated at 56 and compares a plurality of track sections 56*a*–56*c*. Each section 56*a*–56*c* may consist of several miles or any other designated length of track. The monorail guideway 56 is mounted upon vertical support columns 58*a*–58*c*. Each of the steel columns 58*a*–58*c* is typically of wide flange construction having a central body member 60*a*–60*c* and laterally extending flanges 62*a*–62*c* and 64*a*–64*c*. Columns 58*a*–58*c* are engineered to be spaced a predetermined distance apart, depending upon site conditions, expected loads and length of track.

With continued reference to FIG. 2 it will be seen that the guideway assembly 56 consists of a running surface 66 that is supported by beams 68–69 and truss 70. Surface 66 is preferably constructed of plate steel. Beams 68 and 69 and truss 70 are typically of tubular steel construction and are fabricated according to conventional cold-rolling processes.

Brackets 72*a*–72*c* are welded to the underside of running surface 66 on one side of the guideway assembly 56 at spaced locations. Corresponding brackets (not shown) are mounted on the other side of guideway assembly 56.

Figure 3:
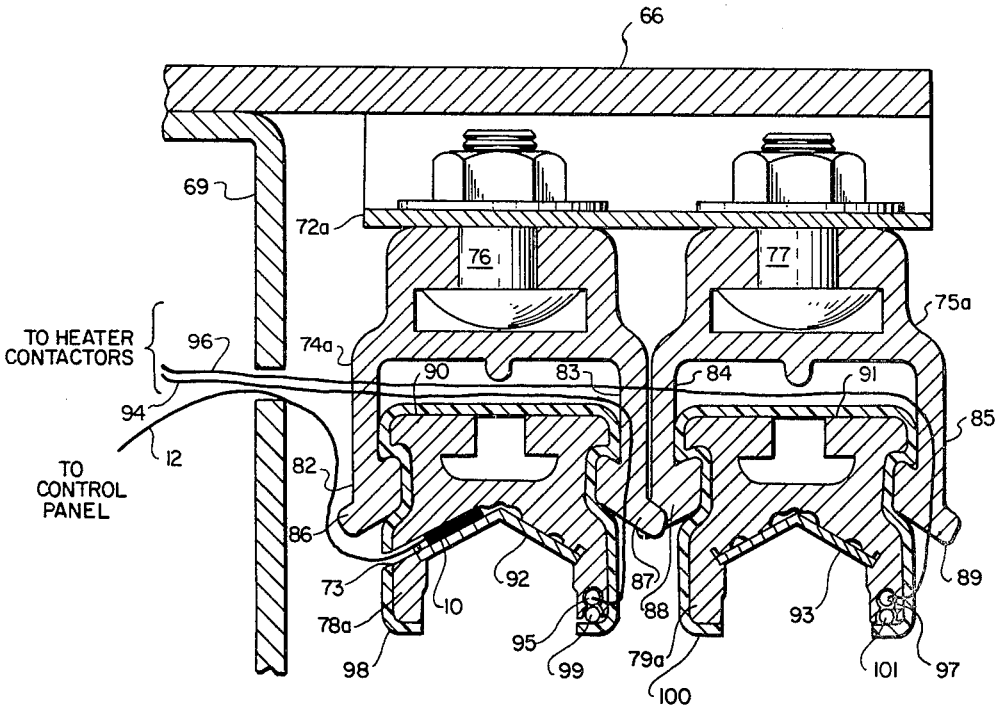
FIG. 3 is a cross-sectional view of the AGT system track bus bars located on one side of the guideway assembly shown in FIG. 2.

As shown in FIG. 2 and as hereinafter more fully described in connection with FIG. 3, each of the brackets 72*a*–72*c* support a pair of bus bars 78*a*–78*c* and 79*a*–79*c*. Bus bars 80*a*–80*c* and 81*a*–81*c* are similarly supported on the other side of the guideway assembly. Three of the bus bars are used to carry power to the AGT vehicle (not shown) that runs along the guideway assembly. The fourth bus bar carries a control signal that is used by the AGT vehicle (not shown) to control its operation. The details of mounting and construction of bus bars 78*a* and 79*a* on section 56*a* of guideway assembly 56 are shown in FIG. 3. It will of course be understood that the bus bars mounted on both sides of the other sections 56*b*–56*c* are constructed and mounted to the guideway assembly 56 in a like manner.

As shown in FIG. 3, clamps 74*a* and 75*a* are mounted to the bracket 72*a* by bolts 76 and 77. The clamps 74*a* and 75*a* are typically constructed of resilient ceramic or plastic material, for purposes to be hereinafter more fully described. Also, as shown in FIG. 2 the clamps 74*a* and 75*a* are longitudinally offset since their overall width in relation to the width of bracket 72*a* (see FIG. 3) slightly overlaps. The downwardly depending arms 82–85 of clamps 74*a* and 75*a* are resilient and are adapted to be spread apart so that they may receive metal bus bars 78*a* and 79*a*. Detents 86–89 provided at the ends of arms 82–85 lockingly engage the bus bars 78*a* and 79*a* in mating relationship as illustrated.

The body portion 90–91 of bus bars 78*a*–79*a* consists of extruded aluminum. The body portion 90–91 is crimped onto a steel or copper conducting surface 92–93 shaped as an inverted "V." Heater wires 95,97 are embedded in the body portion 90–91 immediately below the conducting surfaces 92 and 93, and are energized by control wires 94, 96 which are from the power profile controller 55*a* (see FIG. 2). Heater wires 95,97 are typically constructed of nichrome wire and are retained in place by a keeper wire such as illustrated at 99,101. When the heater wires 95,97 are turned on by the control circuitry described above in connection with FIG. 1, heat is transmitted through the aluminum extrusion to the conducting surfaces 92 and 93 so as to prevent formation of frost or dew thereon. The body portion 90–91 of bus bars 78*a*–79*a* is also encased by a polyvinyl chloride (PVC) insulating layer 98, 100 which helps to insulate the bus bars 78*a*–79*a*.

As previously described, the RTD 10 (see FIG. 1) is attached to one of the bus bars, as for example bus bar 78*a*. The RTD probe 10 is typically buried in the bus bar in a hole 73 drilled into the side of the bus bar 78*a*, as shown in FIG. 3, and is coupled through cable wiring, as schematically illustrated at 12, which is run through the interior of truss 70 and then out through a conduit 102*a* (see FIG. 2) mounted on the central body member 60*a* of column 58*a*.

In the embodiment illustrated in FIG. 2, the dew point cell 20 is mounted on the underside of truss 70 and is coupled through conduit 102*a* to control panel housing 14. The heating system power profile controllers 55*a*–55*c* for each section 56*a*–56*c* of the AGT system guideway assembly are mounted inside truss 70.

In its operation, dew point cell 20 monitors the ambient dew point temperature which is transmitted to the control panel housing 14 and the circuitry contained therein as described in connection with FIG. 1. The bus bar temperature is monitored through the temperature probe 10 that is coupled through conduit 102*a* to control panel housing 14 and the circuitry contained therein. Thus, as described above, if the bus bar structural temperature reaches the ambient dew point temperature and if the bus bar structural temperature is below freezing as determined by comparator 36 (see FIG. 1), then the control circuitry of FIG. 1 activates the heating system power profile controllers 55*a*–55*c* which then energize the heater wires 95,97 (see FIG. 3) for each of the bus bars 78–81 along each section 56*a*–56*c* of the AGT guideway assembly.

As schematically illustrated in FIG. 2 the control panel housing 14 may be located at a distance that is remote from the guideway structure so as to be less susceptible to noise and other interference signals generated by the AGT system operation.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A temperature control system comprising:

(a) a first sensor for detecting the temperature of an object;

(b) a second sensor for detecting the dew point temperature of the ambient atmosphere about said object;

(c) a first electronic circuit coupled to said first sensor, said first circuit converting the detected temperature of said object into a first electrical signal that is proportional to the detected temperature of said object;

(d) a second electronic circuit coupled to said second sensor, said second circuit converting the detected dew point temperature into a second electrical signal that is proportional to said detected dew point temperature;

(e) means for receiving said first and second signals from said first and second circuits and for thereafter comparing said received signals;

(f) means for heating said object; and (g) means for energizing said means (f), the energizing means (g) being coupled to said heater means (f) and controlled by said means (e) for receiving and comparing the said signals so that said heater means (f) will be energized by the energizing means (g) when said first signal reaches a selected level in relation to said second signal, thereby maintaining said object at a temperature that is slightly above the ambient dew point temperature in order to prevent the formation of frost or dew thereon.

2. A temperature control system as defined in claim 1 wherein said first sensor comprises a resistant temperature device.

3. A temperature control system as defined in claim 1 wherein said second sensor comprises a dew point cell.

4. A temperature control system as defined in claim 1 wherein said first circuit comprises a solid state amplifier circuit that produces a linear output voltage that varies in proportion to said detected temperature of said object.

5. A temperature control system as defined in claim 1 wherein said second circuit comprises a solid state amplifier circuit that produces an output voltage proportional to the detected dew point temperature.

6. A temperature control system as defined in claim 1 wherein said means (e) comprise a first electronic comparator circuit.

7. A temperature control system as defined in claim 6 further comprising:

(h) means, interconnected between said first comparator circuit and said energizing means (g), for disabling said energizing means (g) whenever the detected temperature of said object is greater than a preset reference value.

8. A temperature control system as defined in claim 7 wherein said disabling means (h) comprise:

a second electronic comparator circuit; and an AND gate connected to the outputs of said first and second comparator circuits.

9. A temperature control system as defined in claim 1 wherein said energizing means (g) comprise a solid state relay.

10. A temperature control system as defined in claim 9 wherein said energizing means (g) further comprise a time delay circuit connected to said relay, said time delay circuit energizing the relay in response to a signal of predetermined duration and magnitude.

11. A temperature control system as defined in claim 10 wherein said energizing means (g) further comprise an output interface device connected to said relay.

12. A temperature control system as defined in claim 11 wherein said energizing means (g) further comprise a power profile controller connected to said output interface device, said power profile controller being energized by said output interface device and thereafter gradually turning on said heater means (f).

13. A temperature control system as defined in claim 1 further comprising:

(h) means for isolating said first and second signals from ground loop currents.

14. A temperature control system as defined in claim 13 wherein said isolating means (h) comprise an optical isolating transmitter circuit.

15. A temperature control system for preventing the formation of frost or dew on the bus bars of an AGT system, the temperature control system comprising:

(a) a heating element for heating said bus bars;

(b) a first sensor placed in contact with one of said bus bars so as to detect the bus bar temperature;

(c) a second sensor for detecting the dew point temperature of the ambient atmosphere about said AGT system guideway;

(d) a first electronic amplifier circuit coupled to said first sensor, said first amplifier circuit converting the detected bus bar temperature into a first electrical signal that is proportional to the detected bus bar temperature, and thereafter amplifying and transmitting said first signal;

(e) a second electronic amplifier circuit coupled to said second sensor, said second amplifier circuit converting the detected dew point temperature into a second electrical signal proportional to said detected dew point temperature, and thereafter amplifying and transmitting said second signal;

(f) a first electronic comparator circuit coupled to the outputs of said first and second amplifier circuits, said first comparator circuit detecting the magnitude of the difference between the transmitted first and second signals and triggering a first output signal whenever said difference reaches a set level;

(g) a second electronic comparator circuit coupled to said first amplifier circuit, said second comparator circuit comparing said first electrical signal to an internal reference signal and triggering a second output signal whenever said first signal is less than or equal to said internal reference signal;

(h) means, coupled to the outputs of said first and second comparator circuits, for developing a triggering signal in response to said first and second output signals from said comparator circuits; and (i) an electronic relay device controlled by said means (h) and coupled to said heating element, whereby said heating element will be energized when the relay is triggered by the triggering signal from said means (h).

16. A temperature control system as defined in claim 15 further comprising a time delay circuit interconnected between said means (h) and said relay, said time delay circuit energizing said relay in response to a triggering signal of selected magnitude and duration from said means (h).

17. A temperature control system as defined in claim 16 further comprising an output interface device connected to the output of said relay.

18. A temperature control system as defined in claim 17 further comprising a power profile controller interconnected between said output interface device and said heating element, said output interface device gradually turning on said heating element when said power profile controller is energized.

19. A temperature control system as defined in claim 18 further comprising an isolating transmitter circuit interconnected between (1) said first amplifier circuit and (2) said first comparator circuit.

20. A method of controlling the temperature of an object comprising the steps of:

detecting the temperature of said object;

detecting the dew point temperature of the ambient atmosphere about said object;

determining the magnitude of the difference between said detected temperature of the object and said detected dew point temperature; and heating said object when said difference reaches a predetermined level, thereby maintaining the temperature of said object slightly above the dew point temperature of the ambient atmosphere.

21. A method of controlling the temperature of an object comprising the steps of:

detecting the temperature of said object;

detecting the dew point temperature of the ambient atmosphere about said object;

converting the detected temperature of said object to a first electrical signal that is proportional to said detected temperature of the object;

converting the detected dew point temperature to a second electrical signal that is proportional to said detected dew point temperature;

detecting the magnitude of the difference between said first and second electrical signals; and energizing a heating device whenever said difference reaches a set level, whereby said heating device will maintain the temperature of said object above the ambient dew point temperature in order to prevent formation of frost or dew thereon.

22. A method as defined in claim 21 further comprising the step of disabling said heating device whenever said detected temperature of the object is greater than a selected reference signal that corresponds to the freezing point of 32° F. (0° C.).

23. A method as defined in claim 21 wherein said energizing step comprises the step of gradually turning on said heating device.

24. In an AGT system comprising a plurality of bus bars for use as power and control signal rails, and wherein each bus bar is provided with a heating element, a method of controlling the bus bar temperature in relation to the ambient dew point temperature, the method comprising the steps of:

monitoring the bus bar temperature through a temperature probe placed in contact with at least one of said bus bars;

converting said bus bar temperature to a first electrical signal that is proportional to said bus bar temperature;

monitoring the ambient dew point temperature through a dew point cell placed in proximity to said AGT system guideway;

converting said dew point temperature to a second electrical signal that is proportional to said dew point temperature;

comparing said first and second signals; and energizing said heating elements whenever said first signal reaches a predetermined value in relation to said second signal.

25. A method as defined in claim 24 further comprising the step of preventing said energizing step whenever the bus bar temperature is above the freezing point.

26. A method as defined in claim 25 wherein said energizing step comprises gradually energizing said heating elements.

27. A method as defined in claim 24 wherein said step of monitoring the bus bar temperature comprises the step of placing a plurality of temperature probes in contact with said bus bars at various points along the length of said AGT system guideway.

28. A method as defined in claim 27 wherein said step of comparing the bus bar temperature to the ambient dew point temperature comprises the step of comparing in turn the bus bar temperature monitored at each probe with the dew point temperature monitored by said dew point cell.

* * * * *